US006036451A

United States Patent [19]

Badger et al.

[11] Patent Number: 6,036,451

[45] Date of Patent: Mar. 14, 2000

[54] SHAFT ASSEMBLIES FOR LINESHAFT TURBINE PUMP

[76] Inventors: Omer R. Badger, 4190 W. Cessna; Robert D. Hardin, 9845 Alice Rd.; Gerald D. Tomkins, 9200 S. Beechrcaft, all of Winnemucca, Nev. 89445

[21] Appl. No.: 09/033,577

[22] Filed: Mar. 3, 1998

[51] Int. Cl.[7] ..... F04B 35/01; F16B 7/00

[52] U.S. Cl. ..... 417/360; 417/423.6; 417/424.1; 403/300; 29/890.124

[58] Field of Search ..... 29/890.124, 888.3; 403/43, 300, 301; 417/365, 360, 423.6, 424.1; 166/377

[56] References Cited

U.S. PATENT DOCUMENTS

| | | | |
|---|---|---|---|
| 838,448 | 12/1906 | Pitcher | 403/43 |
| 880,255 | 2/1908 | Vandegrift et al. | 403/300 |
| 1,058,482 | 4/1913 | Spurgeon | 403/301 |
| 1,236,145 | 8/1917 | Burns | 285/286.1 |
| 2,049,489 | 7/1936 | Burns et al. | 29/245 |
| 2,059,175 | 10/1936 | Myracle | 403/46 |
| 2,067,377 | 1/1937 | Burns et al. | 464/21 |
| 2,392,033 | 1/1946 | Eaton | 204/197.14 |
| 2,438,313 | 3/1948 | Burton | 403/300 |
| 2,999,552 | 9/1961 | Fox | 285/333 |
| 3,424,479 | 1/1969 | Ditson et al. | 285/94 |
| 3,551,999 | 1/1971 | Gutmann | 29/517 |
| 3,842,619 | 10/1974 | Bychurch, Sr. | 464/182 |
| 3,871,786 | 3/1975 | Rennerfelt | 403/300 |
| 4,500,224 | 2/1985 | Ewing | 403/343 |
| 4,778,349 | 10/1988 | Browning | 417/231 |
| 5,331,736 | 7/1994 | Suggs | 29/890.124 |
| 5,639,227 | 6/1997 | Mills | 417/423.11 |

*Primary Examiner*—Erick R. Solis
*Assistant Examiner*—Arnold Castro
*Attorney, Agent, or Firm*—Workman, Nydegger and Seeley

[57] ABSTRACT

A lineshaft turbine pump includes a packing container having a passageway longitudinally extending therethrough. Rotatably disposed within the passageway is a packing sleeve having a channel longitudinally extending between a threaded first end and an opposing threaded second end. A threaded first end of a line shaft is loosely threaded within the second end of the packing sleeve. Disposed within the channel of the packing sleeve is a thrust shaft. The thrust shaft has a second end biased against the first end of the line shaft. A threaded second end of a drive shaft is screwed into the first end of the packing sleeve such that the drive shaft biases against the first end of the thrust shaft, thereby applying longitudinal force against the line shaft.

20 Claims, 4 Drawing Sheets

SHAFT ASSEMBLIES FOR LINESHAFT TURBINE PUMP

BACKGROUND OF THE INVENTION

1. The Field of the Invention

The present invention relates to lineshaft turbine pumps and, more specifically, shaft assemblies for lineshaft turbine pumps.

2. Present State of the Art

Lineshaft turbine pumps are uniquely configured for pumping fluids through large elevational differences such as from the bottom of wells or mines. A typical lineshaft turbine pump includes an elongated hollow pipe having a bottom end that is selectively positioned within the fluid to be pumped, such as in the bottom of a well. Positioned at the bottom end of the pipe is shaft driven pump. The top end of the pipe is positioned at ground surface and has a discharge head attached thereto. The discharge head is fluid coupled to the pipe and has a discharge port which exits through the side thereof. A discharge line is fluid coupled to and extends from the discharge port.

Mounted to the discharge head in axial alignment with the pipe is a packing container. The packing container has a passageway longitudinally extending therethrough. Positioned above the packing container is a motor. A drive shaft is rotatably positioned within the passageway of the packing container. The drive shaft has a first end engaged with the motor and an opposing second end disposed within the discharge head below the packing container. A line shaft is disposed within the pipe. The line shaft has a first end coupled to the second end of the drive shaft and an opposing second end that is coupled to the pump. During operation, the motor rotates the drive shaft which in turn rotates the line shaft. Rotation of the line shaft operates the pump which draws water from the exterior into the pipe. The water flows up the pipe and out the discharge head through the discharge port and discharge line.

The function of the packing container is to seal around the drive shaft such that fluid passing through the discharge head can exit only through the discharge port and not leak out around the drive shaft. To effect this seal, the packing container includes a soft packing material which is tightly compressed around a portion of the drive shaft positioned within the packing container. The packing material enables the drive shaft to freely rotate within the packing container while effecting a liquid tight seal.

After extended periods of operation, the packing material can wear away at the drive shaft, eventually resulting in fluid leaking thereat. To stop the leaking, it is necessary to replace the drive shaft. Conventional designs of lineshaft turbine pumps, however, can make replacement of the drive shaft extremely difficult. Initially, the drive shaft must be separated from the line shaft. The ends of these two shafts are initially coupled together by each screwing into opposing ends of a threaded coupler. Rotation of the drive shaft, however, results in the drive shaft being tightly threaded into the coupler.

Separating these two elements requires an individual to remove the discharge line and then reach into the discharge head through the discharge port with a wrench. As the coupler is held stationery by one wrench, an opposing wrench positioned above the packing container and below the motor is used to loosen the drive shaft. Minimal space within the discharge head makes it extremely awkward and very difficult to position and manipulate the wrench therein.

Furthermore, it is difficult to obtain the proper leverage often necessary to loosen the rigid connection.

Frequently, it is impossible for an individual to disconnect the drive shaft from the threaded coupler. In such situations, it is necessary to remove the motor from off the discharge head and thereby provide access to the drive shaft by disassembling the system. This process is very expensive since it requires a large crane to lift the motor for removal and results in extensive down time during disassembly and then reassembly of the system.

BRIEF SUMMARY AND OBJECTS OF THE INVENTION

Accordingly, it is an object of the present invention to provide improved operational life of lineshaft turbine pumps.

Another object of the present invention is to provide improved lineshaft turbine pumps wherein the accessibility of the connection between the drive shaft and the line shaft is maximized.

Yet another object of the present invention is to provide improved lineshaft turbine pumps wherein the worn shaft extending through the packing container can be easily and quickly replaced without the necessity of having to remove the motor or remove the discharge line from the discharge head.

To achieve the foregoing objects, and in accordance with the invention as embodied and broadly described herein, a lineshaft turbine pump is provided. The lineshaft turbine pump includes a pipe having a first end and an opposing second end. A shaft driven pump is mounted to the second end of the pipe. A discharge head is mounted to the first end of the pipe. The discharge head has an interior chamber in fluid communication with the pipe and also has a discharge port extending through the side thereof. A discharge line is fluid coupled to and extends from the discharge port. A packing container is mounted to the discharge head. A passageway extends through the packing container in axial alignment with the pipe. Mounted above the packing container in alignment with the passageway is a motor.

A shaft assembly extends from the motor, through the passageway in the packing container, and to the pump. The motor rotates the shaft assembly which in turn operates the pump. The pump draws fluid from the exterior into the pipe. The fluid then advances up through the pipe, into the discharged head, and out the discharge port.

The shaft assembly includes a packing sleeve rotatably disposed within the passageway of the packing container. The packing sleeve has a channel extending between a first end and an opposing second end. A line shaft is disposed within the pipe and has a first end loosely threaded within the second end of the packing sleeve and an opposing second end coupled to the pump. A thrust shaft is disposed within the channel of the packing sleeve. The thrust shaft has a first end and an opposing second end. The second end of the thrust shaft is biased against the first end of the line shaft within the packing sleeve. Finally, the first end of a drive shaft is coupled to the motor and the second end of the drive shaft is threadedly received within the first end of the packing sleeve.

The packing sleeve and related thrust shaft are configured such that as the drive shaft is screwed into the packing sleeve, the drive shaft butts up against the first end of the thrust shaft. In turn, the second end of the thrust shaft pushes against the first end of the line shaft. Accordingly, by tightly screwing the drive shaft against the thrust shaft within the packing sleeve, a rigid coupling is produced between the line shaft and packing sleeve without having to tightly screw the line shaft into the packing sleeve. In this assembled condition, the lineshaft turbine pump is ready for operation.

During disassembly, the second end of the drive shaft, which is openly exposed, can be easily unscrewed from the first end of the packing sleeve. Once this is done, the force applied by the thrust shaft on the line shaft is released. It is then relatively easy to unscrew the loosely threaded packing sleeve from the line shaft. The packing sleeve can then be removed and replaced when needed. Typically, friction between the pump impellers and the pump bowls prevents rotation of the line shaft as the packing sleeve is being unscrewed therefrom. Should the line shaft rotate with the packing sleeve, however, a retention tool can be inserted within the channel of the packing sleeve and screwed into the first end of the line shaft. The retention tool is then used to hold the line shaft stationary as the packing sleeve is unscrewed therefrom. Accordingly, by using the inventive assembly, it is not necessary to remove the discharge line to replace the packing sleeve.

The above inventive structure and process can be used to easily replace the packing sleeve when worn. The present invention eliminates the need for removal of the motor, removal of the discharge line, or complete disassembly of the system. These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
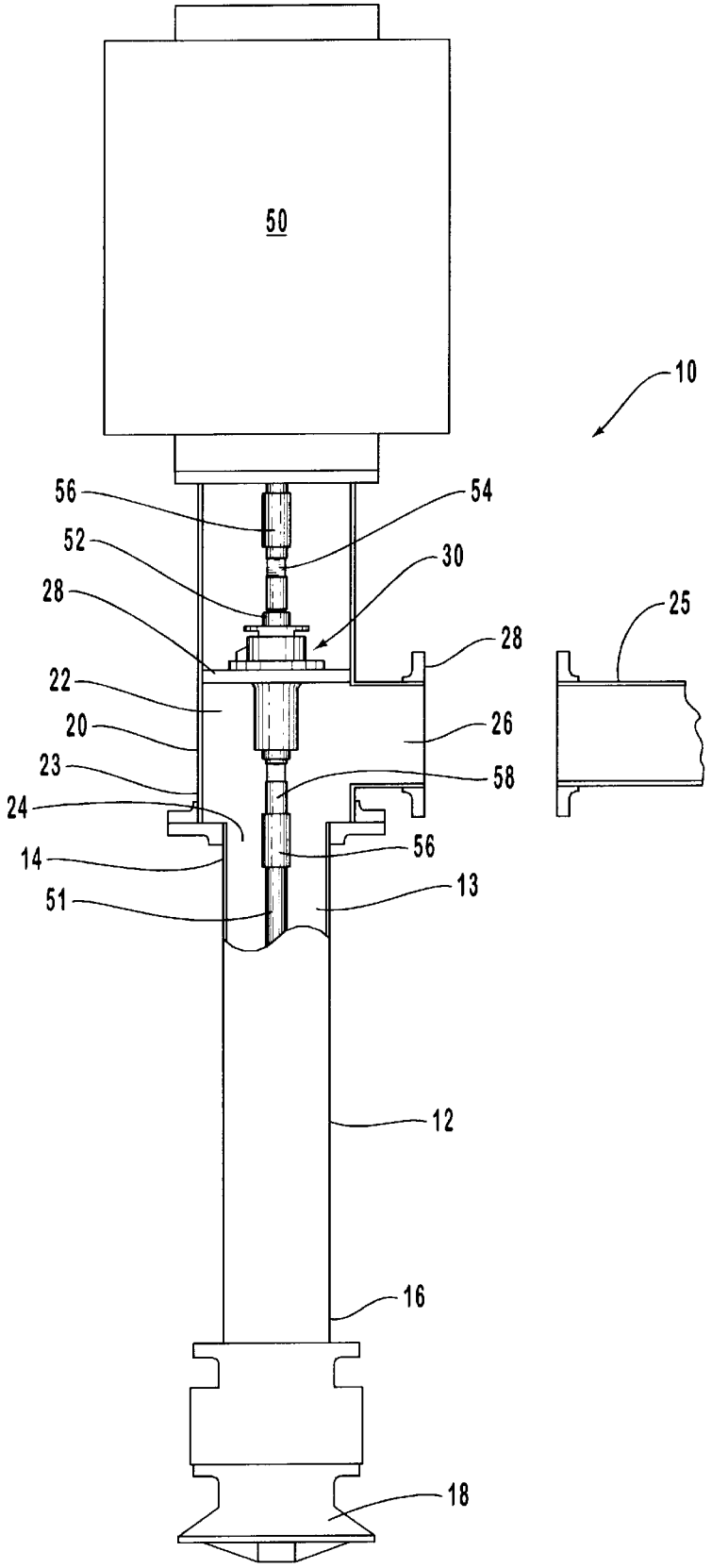
FIG. 1 is a partially cut away elevated front view of a lineshaft turbine pump.

Depicted in FIG. 1 is one embodiment of a lineshaft turbine pump 10 incorporating features of the present invention. Lineshaft turbine pump 10 includes an elongated pipe 12. Pipe 12 bounds a pathway 13 extending between a top end 14 and a bottom end 16. In one embodiment, pipe 12 is comprised of a plurality of sections which are coupled together to obtain a desired length.

Mounted to bottom end 16 of pipe 12 is a shaft driven pump 18. One example of pump 18 is a multistage vertical turbine pump.

Mounted to top end 14 of pipe 12 is a discharge head 20. Discharge head 20 bounds a chamber 22 that extends between a ceiling wall 28 and a base end 23. Chamber 22 communicates with pathway 13 through an opening 24 at base end 23. Chamber 22 also communicates with the exterior through a discharge port 26 extending through the side of discharge head 20. Discharge port 26 is surrounded by an annular flange 28. A discharge line 25 is coupled to and extends from discharge port 26.

Figure 2:
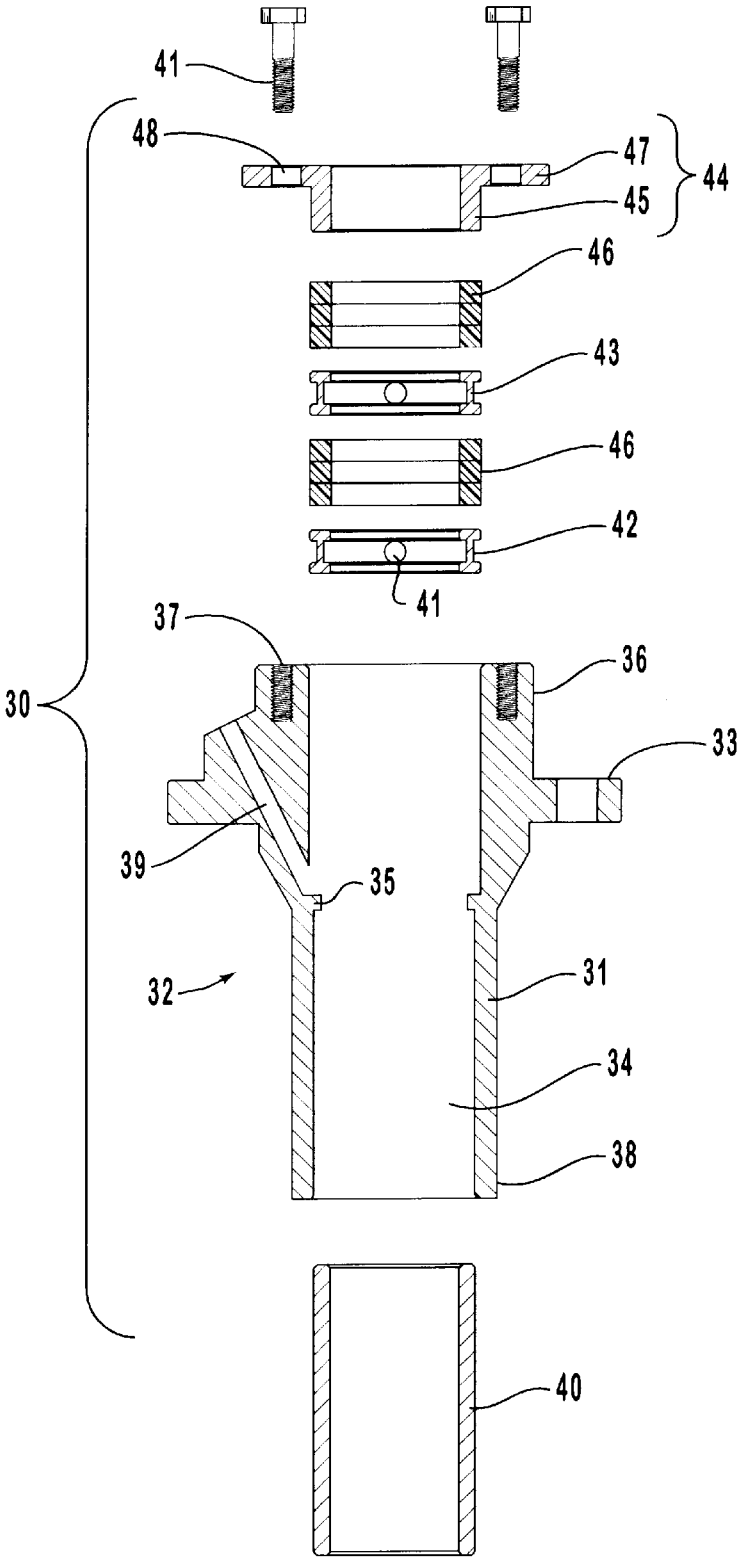
FIG. 2 is a cross-sectional elevated front view of a packing container shown in FIG. 1 in a disassembled condition.

Extending through ceiling wall 28 is a packing container 30. Depicted in FIG. 2, packing container 30 comprises a stuffing box 32. Stuffing box 32 includes a tubular sidewall 31 that bounds a passageway 34 extending between a first end 36 and an opposing second end 38. Formed at first end 36 are a plurality of threaded recesses 37. An annular mounting flange 33 radially outwardly projects from sidewall 31. Mounting flange 33 facilitates attachment of stuffing box 32 to discharge head 20. An annular positioning ridge 35 radially inwardly projects from sidewall 31 into passageway 4 A conduit 39 extends from the exterior to passageway 34 through sidewall 31.

Second end 38 of stuffing box 32 is configured to receive a replaceable tubular bearing 40. First end 36 of stuffing box 32 is configured to receive a tubular first lantern ring 42 and a tubular second lantern ring 43. Each lantern ring 42 and 43 has a plurality of holes 41 extending through the side thereof. Disposed between and above lantern rings 42 and 43 is packing 46. Packing 46 typically comprises Teflon or carbon impregnated cord that is wound in a tubular coil.

Packing 46 is held within stuffing box 32 by a cap 44. Cap 44 comprises a tubular collar 45 having an annular flange 47 radially outwardly projecting therefrom. Flange 47 has a plurality of apertures 48 extending therethrough. When collar 45 is received within first end 36 of stuffing box 32, apertures 48 align with corresponding threaded recesses 37. Bolts 41 can then be used to secure cap 44 to stuffing box 32.

Returning back to FIG. 1, positioned above discharge head 20 in alignment with packing container 30 is a motor 50. One example of motor 50 is a vertical hollow shaft motor. Motor 50 is used to drive a shaft assembly 51 which extends from motor 50 to pump 18. Rotation of shaft assembly 51 operates pump 18. In turn, pump 18 draws fluid from the exterior through pump 18 and into pathway 13 of pipe 12. The fluid then travels up pathway 13 and into chamber 22 of discharge head 20. The fluid is subsequently dispelled out through discharge port 26.

The above elements of lineshaft turbine pump 10, excluding inventive shaft assembly 51 but including pipe 12, pump 18, discharge head 20, packing container 30, and motor 50, can be purchased off the shelf For example, such elements can be purchased from the Ingersoll-Rand Company out of Hastings, Nebr.

As depicted in FIG. 1, the inventive shaft assembly 51 includes a packing sleeve 52 rotatably disposed within passageway 34 of packing container 30. A drive shaft 54 extends between motor 50 and packing sleeve 52. Drive shaft 54 can come in a plurality of sections which are attached together by threaded couplers 56. A line shaft 58 extends between packing sleeve 52 and pump 18. Line shaft 58 can also comprise a plurality of different sections which are attached together by threaded couplers 56.

Figure 3:
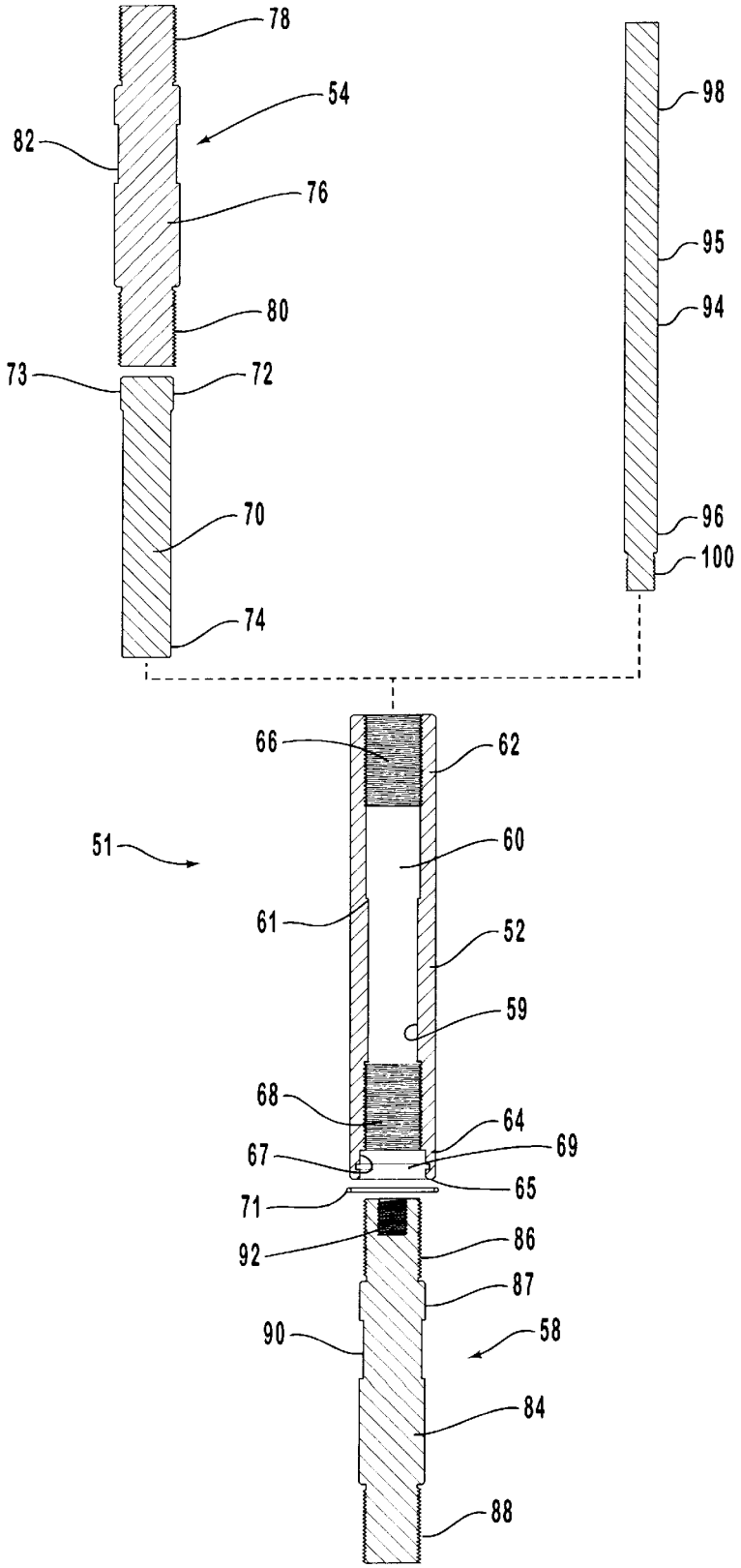
FIG. 3 is a cross-sectional elevated front view of a shaft assembly shown in FIG. 1 in a disassembled condition.

Depicted in FIG. 3, packing sleeve 52 is shown as further comprising an interior surface 59 bounding a channel 60. Channel 60 extends between a first end 62 and an opposing second end 64. Second end 64 ends at a terminus 65. An annular shelf 61 radially inwardly projects from interior surface 59 between ends 62 and 64. Formed on interior surface 59 at first end 62 are threads 66. Threads 68 are also formed on interior surface 59 at second end 64. Interior surface 59 includes a smooth walled sealing portion 67 extending between threads 68 and terminus 65. An annular groove 69 is recessed within sealing portion 67. Groove 69 is configured to receive an o-ring 71.

Shaft assembly 51 further includes a thrust shaft 70 having a first end 72 and an opposing second end 74. Thrust shaft 70 is configured to be received within channel 60 of packing sleeve 52. This is accomplished by sliding second end 74 of thrust shaft 70 into first end 62 of packing sleeve 52.

In one embodiment of the present invention, means are provided for preventing the passage of thrust shaft 70 completely through channel 60 of packing sleeve 52. By way of example and not by limitation, radially projecting out from first end 72 of thrust shaft 70 is an annular flange 73. Flange 73 of thrust shaft 70 has an outer diameter that is larger than the inner diameter of shelf 61 of packing sleeve 52. As a result, when thrust shaft 70 is freely disposed within packing sleeve 52, flange 73 rests against shelf 61 to prevent thrust shaft 70 from completely passing through packing sleeve 52. In one embodiment, thrust shaft 70 has a length such that when first end 72 of thrust shaft 70 is disposed within threads 66 of packing sleeve 52, second end 74 of thrust shaft 70 is disposed within threads 68 of packing sleeve 52.

As depicted in FIG. 3, drive shaft 54 includes a head shaft 76 having a threaded first end 78 configured for engagement with collar 56 (shown in FIG. 1) and a threaded second end 80. Formed on head shaft 76 is a flat wrench slot 82. Line shaft 58 also includes an intermediate shaft 84 which also has a threaded first end 86 and an opposing threaded second end 88. A threaded bore 92 is formed at first end 86 in axial alignment with line shaft 58. Intermediate shaft 84 also includes a flat wrench slot 90 formed thereon. Extending between wrench slot 90 and threaded first end 86 is a sidewall portion 87.

Operable with shaft assembly 51 is a retention tool 94. Retention tool 94 has a handle 95 extending from a first end 96 to an opposing second end 98. Handle 95 is configured to be received within channel 60 of packing sleeve 52 and has a length greater than packing sleeve 52. In one embodiment, means are provided for removably attaching first end 96 of retention tool 94 to first end 86 of line shaft 58. By way of example and not by limitation, a threaded head 100 is formed at first end 96 and is configured to threadedly engage bore 92 on line shaft 58. In alternative embodiments, various interlocking socket configurations can also be used.

Figure 4:
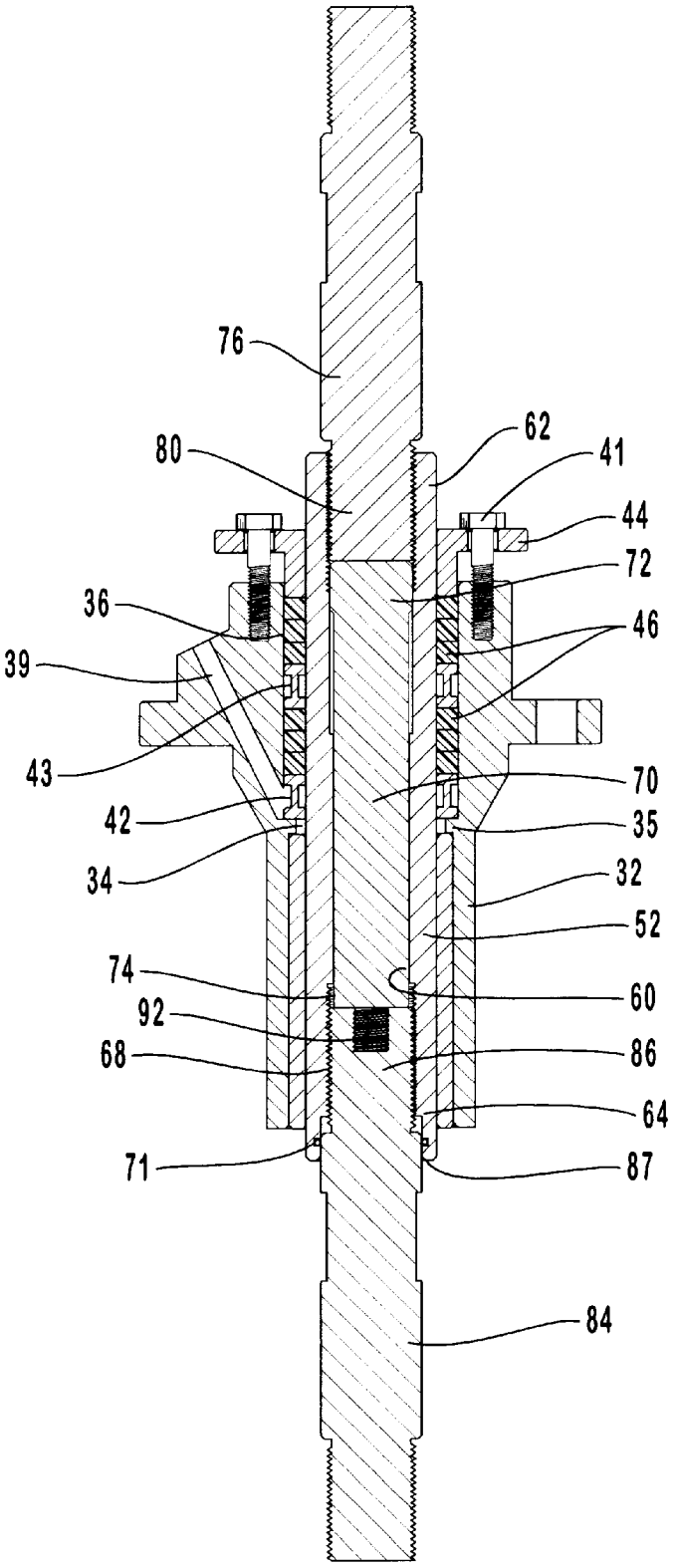
FIG. 4 is a cross-sectional elevated front view of the shaft assembly shown in FIG. 1 disposed within the packing container shown in Figure

During assembly, as depicted in FIG. 4, packing sleeve 52 is initially rotatably disposed within passageway 34 of stuffing box 32. In this position, second end 64 of packing sleeve 52 is loosely threaded onto first end 86 of intermediate shaft 84. This is typically accomplished by screwing packing sleeve 52 onto intermediate shaft 84 until intermediate shaft 84 bottoms out, and then partially backing packing sleeve 52 off of intermediate shaft 84. One of the benefits of the present system is that since these elements need only be "loosely tightened" it is not necessary that wrenches be used within discharge head 20 for tightly securing the elements together.

In one embodiment of the present invention, means are provided for effecting a fluid tight seal between the exterior and threads 68 at second end 64 of packing sleeve 52 when first end 86 of line shaft 58 is threadedly engaged within second end 64 of packing sleeve 52. By way of example and not by limitation, sidewall portion 71 of intermediate shaft 84 is configured to bias against o-ring 71, thereby effecting a liquid tight seal between packing sleeve 52 and intermediate shaft 84. This liquid tight seal prevents fluid from reaching threads 68 which could produce rusting. In alternative embodiments, o-ring 71 can also be mounted to intermediate shaft 84. Alternatively, other types of gaskets or sealing arrangements can also be used.

Means are also provided for effecting a substantially fluid tight seal between stuffing box 32 and packing sleeve 52. By way of example and not by limitation, lantern rings 42 and 43 and packing 46 are positioned within first end 36 of stuffing box 32 so as to be disposed between packing sleeve 52 and the interior surface of stuffing box 32. Lantern ring 42 biases against positioning ridge 35 to prevent further advancement therein. Next, cap 44 is slid over first end 62 of packing sleeve 52 such that collar 45 is disposed against packing 46. Bolts 41, as previously discussed, are then used to screw cap 44 to stuffing box 32. As bolts 41 are tightened, packing 46 is longitudinally compressed between cap 44 and lantern rings 42 and 43, thereby laterally expanding packing 46. As packing 46 laterally expands, a seal is effected between packing sleeve 52 and stuffing box 32 while still enabling annular rotation of packing sleeve 52.

In one embodiment, conduit 39 lines up with lantern ring 42. Conduit 39 enables the bleed off of fluid to help minimize the pressure against packing 46. Conduit 39 can also be use to deliver grease or other lubricants to packing sleeve 52. A second conduit can also be formed that communicates with lantern ring 43. The second conduit would function the same way as conduit 39.

The present invention also includes, means for tightening the coupling between line shaft 58 and second end 64 of packing sleeve 52 by coupling drive shaft 54 to first end 62 of packing sleeve 52. By way of example and not by limitation, with intermediate shaft 84 loosely threaded into second end 54 of packing sleeve 52, thrust shaft 70 is slid into channel 60 of packing sleeve 52. In this configuration, second end 74 of thrust shaft 70 is biased first end 86 of intermediate shaft 84. Second end 80 of head shaft 76 is next threaded into first end 62 of packing sleeve 52. Head shaft 76 is advanced until second end 80 tightens against first end 72 of thrust shaft 70. As second end 80 of head shaft 76 pushes against thrust shaft 70, thrust shaft 70 in turn pushes against first end 86 of intermediate shaft 84. As a result, a tension force is obtained between intermediate shaft 84 and packing sleeve 52, thereby rigidly securing the two elements together.

In this configuration, operation of motor 50 results in rotation of drive shaft 54. In turn, drive shaft 54 rotates packing sleeve 52 which likewise rotates line shaft 58. The rotation of line shaft 58 operates pump 18 which draws fluid into pipe 12 and out discharge port 26 as previously discussed.

Operation of the system eventually results in wear of packing sleeve 52 as a result of packing 46 rubbing thereagainst. Replacement of packing sleeve 52 entails removing or at least loosening head shaft 76 from first end 62 of packing sleeve 52. This is easily accomplished since head shaft 76 is positioned outside of discharge head 20 and is either openly exposed or is easily openly exposed. Once head shaft 76 is loosened, the force applied by thrust shaft 70 on intermediate shaft 84 is removed. Accordingly, intermediate shaft 84 and packing sleeve 52 are now again only loosely threaded together. Since o-ring 71 prevents intermediate shaft 84 and packing sleeve 52 from rusting together, packing sleeve 52 can be easily unthreaded from intermediate shaft 84 by simply rotating the exposed first end 62 of packing sleeve 52. This can often be accomplished by hand without the required use of wrenches. Once unthreaded from intermediate shaft 84, packing sleeve 52 can be removed and replaced using the initial assembly steps.

Typically, friction between the pump impellers and the pump bowls prevents rotation of line shaft 58, and thus intermediate shaft 84, as packing sleeve 52 is being unscrewed therefrom. Should line shaft 58 rotate with packing sleeve 52, however, retention tool 94 can be inserted within channel 60 of packing sleeve 52 and screwed into bore 92 at first end 86 of line shaft 58. Bore 92 has a thread that is opposite the thread at first end 86 of line shaft 58. As a result, retention tool 94 can be used to hold line shaft 58 stationary as packing sleeve 52 is unscrewed therefrom. Accordingly, by using the inventive assembly, it is not necessary to remove discharge line 25 to replace packing sleeve 52.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A shaft assembly comprising:

(a) a packing sleeve having a channel extending between a first end and an opposing second end;

(b) a line shaft having a first end removably attached to the second end of the packing sleeve;

(c) a thrust shaft movably disposed within the channel of the packing sleeve, the thrust shaft having a first end and an opposing second end, the second end of the thrust shaft being biased against the first end of the line shaft; and (d) a drive shaft having a second end removably attached to the first end of the packing sleeve so as to bias against the first end of the thrust shaft.

2. A shaft assembly as recite in claim 1, further comprising:

(a) the packing sleeve having an interior surface bounding the channel, the interior surface having threads formed at the second end thereof; and (b) the line shaft having an exterior surface with threads formed at the first end, the first end of the line shaft being threadedly engaged within the second end of the packing sleeve.

3. A shaft assembly as recite in claim 2, further comprising means for effecting a fluid tight seal between the exterior and the threads at the second end of the packing sleeve when the first end of the line shaft is threadedly engaged within the second end of the packing sleeve.

4. A shaft assembly as recite in claim 3, wherein the means for effecting a fluid tight seal comprises:

(a) the second end of the interior surface of the packing sleeve including a cylindrical sealing portion extending between the exterior and the threads, the sealing portion having an annular groove formed thereon;

(b) an o-ring received within the annular groove of the sealing portion; and (c) the first end of the line shaft adjacent to the threads thereon being configured to bias against the o-ring when the first end of the line shaft is threadedly engaged within the second end of the packing sleeve.

5. A shaft assembly as recite in claim 1, further comprising:

(a) the packing sleeve having an interior surface bounding the channel, the interior surface having threads formed at the first end thereof; and (b) the drive shaft having an exterior surface with threads formed at the second end, the second end of the drive shaft being threadedly engaged within the first end of the packing sleeve.

6. A shaft assembly as recite in claim 1, means for preventing the passage of the thrust shaft completely through the packing sleeve when the second end of the packing sleeve is freely open.

7. A shaft assembly as recite in claim 6, wherein the means for preventing the passage of the thrust shaft comprises:

(a) a shelf inwardly projecting from the interior surface of the packing sleeve; and (b) a flange outwardly projecting from the exterior surface of the thrust shaft, the flange biasing against the shelf when the thrust shaft is freely disposed within the packing sleeve.

8. An assembly for a vertical pump, the assembly comprising:

(a) a stuffing box having a passageway extending therethrough;

(b) a packing sleeve having a channel extending between a first end and an opposing second end, the packing sleeve being rotatably disposed within the passageway of the stuffing box;

(c) means for effecting a substantially fluid tight seal between the stuffing box and the packing sleeve;

(d) a line shaft loosely coupled to the second end of the packing sleeve;

(e) a drive shaft having an end configured for coupling with the first end of the packing sleeve; and (f) means for tightening the coupling between the line shaft and the second end of the packing sleeve by coupling the drive shaft to the first end of the packing sleeve.

9. An assembly as recited in claim 8, wherein the means for effecting a substantially fluid tight seal comprises packing positioned between the stuffing box and the packing sleeve.

10. An assembly as recited in claim 8, wherein the means for tightening the coupling between the line shaft and the second end of the packing sleeve comprise a thrust shaft movable disposed within the channel of the packing sleeve, the thrust shaft having a first end biased against the drive shaft and a second end biased against the line shaft when the drive shaft is coupled to the first end of the packing sleeve.

11. An assembly as recite in claim 8, further comprising:

(a) the packing sleeve having an interior surface bounding the channel, the interior surface having threads formed at the second end thereof; and (b) the line shaft having an exterior surface with threads formed at the first end, the first end of the line shaft being threadedly engaged within the second end of the packing sleeve.

12. An assembly as recite in claim 11, further comprising:

(a) the second end of the interior surface of the packing sleeve including a cylindrical sealing portion extending between the exterior and the threads, the sealing portion having an annular groove formed thereon;

(b) an o-ring received within the annular groove of the sealing portion; and (c) the first end of the line shaft adjacent to the threads thereon being configured to bias against the o-ring when the first end of the line shaft is threadedly engaged within the second end of the packing sleeve.

13. An assembly as recite in claim 8, further comprising:

(a) the packing sleeve having an interior surface bounding the channel, the interior surface having threads formed at the first end thereof; and (b) the drive shaft having an exterior surface with threads formed at the second end, the second end of the drive shaft being threadedly engaged within the first end of the packing sleeve.

14. An assembly as recite in claim 10, further comprising:

(a) a shelf inwardly projecting from the interior surface of the packing sleeve; and (b) a flange outwardly projecting from the exterior surface of the thrust shaft, the flange biasing against the shelf when the thrust shaft is freely disposed within the packing sleeve.

15. An assembly as recite in claim 8, further comprising a bore recessed within the end of the line shaft coupled to the packing sleeve, the bore being in substantially axial alignment with the line shaft.

16. A vertical pump comprising:

(a) a pipe having a first end and an opposing second end;

(b) a pump mounted to the second end of the pipe;

(c) a discharge head mounted to the first end of the pipe, the discharge head having a discharge port effecting communication between the pipe and the exterior;

(d) a packing container having a passageway extending therethrough, the packing container being mounted to the discharge head such that the passageway communicates with the pipe;

(e) a motor;

(f) a packing sleeve rotatably disposed within the passageway of the packing container, the packing sleeve having a channel extending between a first end and an opposing second end;

(g) a line shaft having a first end coupled to the second end of the packing sleeve and an opposing second end coupled to the pump;

(h) a drive shaft having a first end coupled to the motor and an opposing second end coupled to the first end of the packing sleeve; and (i) a thrust shaft disposed within the channel of the packing sleeve, the thrust shaft having a first end biased against the second end of the drive shaft and a second end biased against the first end of the line shaft.

17. A vertical pump as recite in claim 16, further comprising an o-ring disposed between the packing sleeve and the line shaft.

18. A vertical pump as recite in claim 16, further comprising:

(a) a shelf inwardly projecting from the interior surface of the packing sleeve; and (b) a flange outwardly projecting from the exterior surface of the thrust shaft, the flange biasing against the shelf when the thrust shaft is freely disposed within the packing sleeve.

19. A vertical pump as recite in claim 16, further comprising a bore recessed within the first end of the line shaft.

20. A method for assembling a shaft assembly in a vertical pump, the method comprising the steps of:

(a) rotatably positioning a packing sleeve within the passageway of a packing container, the packing sleeve having a channel extending between a first end an opposing second end;

(b) loosely attaching a first end of a line shaft to the second end of the packing sleeve;

(c) slidably positioning a thrust shaft within the channel of the packing sleeve, the thrust shaft having a first end and an opposing second end biased against the first end of the line shaft; and (d) coupling the second end of a drive shaft to the first end of the packing sleeve such that the drive shaft biases against the thrust shaft.

* * * * *

UNITED STATES PATENT AND TRADEMARK OFFICE

CERTIFICATE OF CORRECTION

PATENT NO. : 6,036,451 
DATED : March 14, 2000
INVENTOR(S) : Omer R. Badger, Robert D. Hardin and Gerald D. Tomkins It is certified that error appears in the above-identified patent and that said Letters Patent is hereby corrected as shown below:

Column 4,
Line 20, after "passageway" change "4" to -- 34. --
Line 51, after "shelf" insert a period Column 6,
Line 3, after "portion" change "71" to -- 87 --
Line 30, after "also be" change "use" to -- used --
Line 42, after "biased" insert --against --

Column 10,
Line 30, after "end" insert -- and --

Signed and Sealed this

Twenty-first Day of January, 2003

JAMES E. ROGAN
*Director of the United States Patent and Trademark Office*